United States Patent [19]

Tanaka et al.

[11] 4,290,070

[45] Sep. 15, 1981

[54] MAGNETIC LOOP ANTENNA WITH DIAMAGNETIC PROPERTIES

[75] Inventors: Osamu Tanaka, 16-37, 5-chome Yoshida Higashi Osaka, Osaka; Nobuo Nakano, Kashiwara; Toyoaki Fukui, Osaka, all of Japan

[73] Assignee: Osamu Tanaka, Osaka, Japan

[21] Appl. No.: 78,761

[22] Filed: Sep. 25, 1979

Related U.S. Application Data

[63] Continuation-in-part of Ser. No. 37,939, May 9, 1979, abandoned.

[51] Int. Cl.[3] ..... G09F 9/00

[52] U.S. Cl. ..... 343/788; 343/787; 343/866

[58] Field of Search ..... 343/787, 788, 842, 867, 343/866

[56] References Cited

U.S. PATENT DOCUMENTS

| | | | |
|---|---|---|---|
| 2,748,386 | 5/1956 | Polydoroff | 343/787 |
| 3,495,264 | 2/1970 | Spears | 343/788 |

*Primary Examiner*—David K. Moore

*Attorney, Agent, or Firm*—Koda and Androlia

[57] ABSTRACT

An antenna including a first elongated magnetic member having at least one diamagnetic portion and a first magnetic pole orientation, a second elongated magnetic member having at least one diamagnetic portion and a second magnetic pole orientation opposite to the first magnetic pole orientation and provided adjacent and parallel to first elongated magnetic member, a pair of third elongated magnetic members connecting the ends of the first and second elongated members to form a magnetic loop and a coil wound on each of the first and second elongated magnetic members.

4 Claims, 8 Drawing Figures

FIG. 3
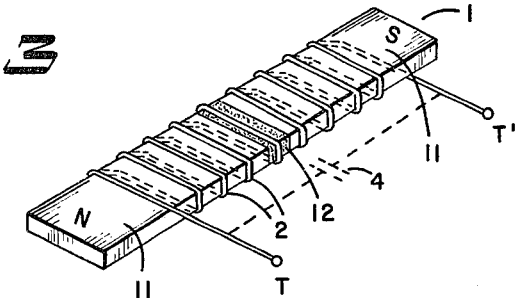
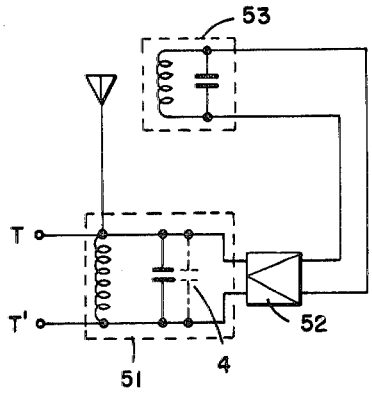
FIG. 4
FIG. 5
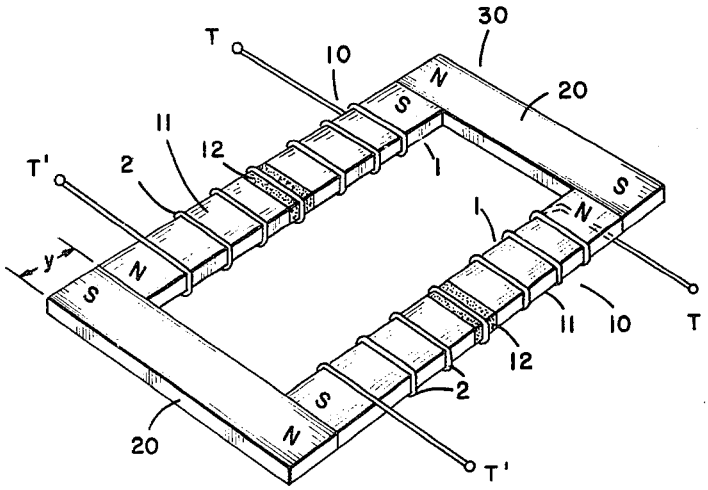

FIG. 6a
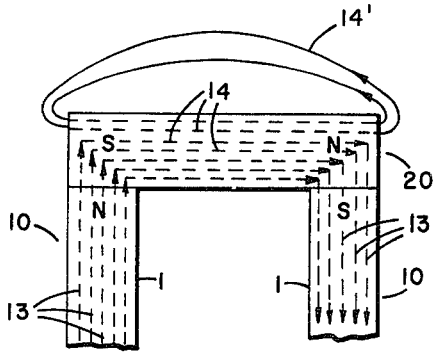
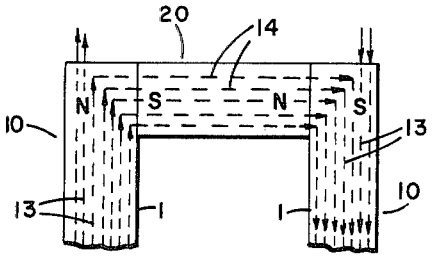
FIG. 6b
FIG. 7
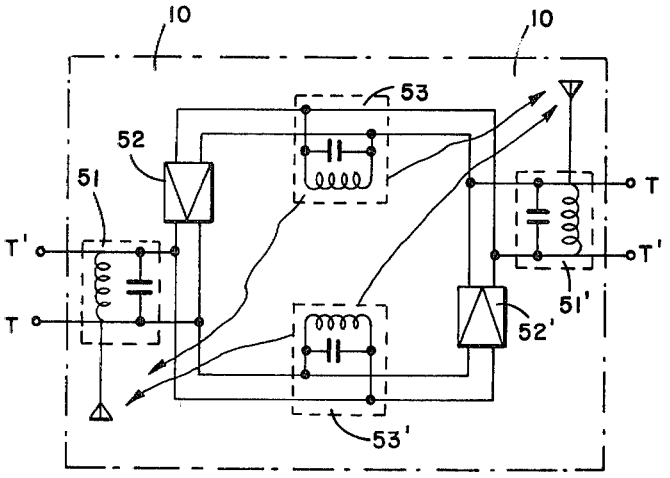

MAGNETIC LOOP ANTENNA WITH DIAMAGNETIC PROPERTIES

CROSS REFERENCE

This is a continuation-in-part of application Ser. No. 037,939 filed May 9, 1979 which is now abandoned.

BACKGROUND OF THE INVENTION

1. Field of the Invention

This invention relates to antennas and more particularly to antennas including magnetic elements.

2. Prior Art

In the prior art there exists many types of antennas. Such antennas include Yagi, Beams, etc. Each of the antennas of the prior art is essentially a passive device and contains or includes no amplifying function.

SUMMARY OF THE INVENTION

Accordingly, it is a general object of the present invention to provide an antenna which is not passive and includes an amplifying function.

In keeping with the principles of the present invention, the objects are accomplished by a unique antenna including a first elongated magnetic member having at least one diamagnetic portion and a first magnetic pole orientation, a second elongated magnetic member having at least one diamagnetic portion and a second magnetic pole orientation opposite to that of the first magnetic pole orientation and provided adjacent and parallel to the first elongated magnetic member, a pair of third elongated magnetic members connecting the ends of the first and second elongated members to form a magnetic loop and a coil wound on each of the first and second elongated magentic members. Furthermore, the lines of magnetic force in the third members connect with the lines of magnetic force in the first and second members.

BRIEF DESCRIPTION OF THE DRAWINGS

The above-mentioned features and objects of the present invention will become more apparent with reference to the following description taken in conjunction with the accompanying drawings wherein like reference numerals denote like elements, and in which:

FIG. 3 illustrates an antenna element in accordance with the teachings of the present invention;

FIG. 4 illustrates an equivalent circuit of the antenna element of FIG. 3;

FIG. 5 illustrates an antenna in accordance with the teachings of the present invention;

FIGS. *6a* & *6b* illustrate the principle of operation of the antenna of FIG. 5; and FIG. 7 illustrates an equivalent circuit of the antenna of FIG. 5.

DETAILED DESCRIPTION OF THE INVENTION

Figure 1:
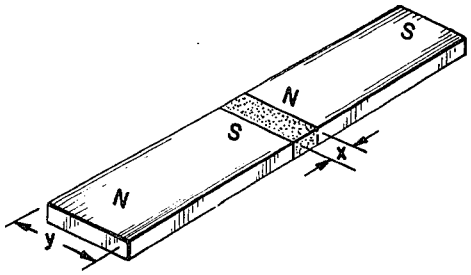
FIG. 1 illustrates a magnetic amplifying member used in the present invention.

Referring to FIG. 1, shown therein is a magnetic amplifying element 1. The magnetic amplifying element 1 is formed by providing one or more diamagnetic parts at fixed intervals in the magnetic field of a magnetic part 11. The diamagnetic part 12 may be made from a material such as carbon or bismuth. A coil is wound around the magnetic amplifying element 1.

The magnetic amplifying element 1 exhibits a phenomenal amplifying effect when subjected to high-frequency excitation. From experimentation the following characteristics have been determined by the present inventor. As is shown by the solid line in FIG. 2(*a*), a change in microcurrent i (FIG. 2(*b*)) is manifested by a change in magnetic flux density $\beta$ (FIG. 2(*c*)). Specifically, it has been determined that a change in microcurrent i on the order of $10^{-8}$ amperes results in a change in magnetic flux density $\beta$ on the order of $10^2$ gauss.

Figure 2:
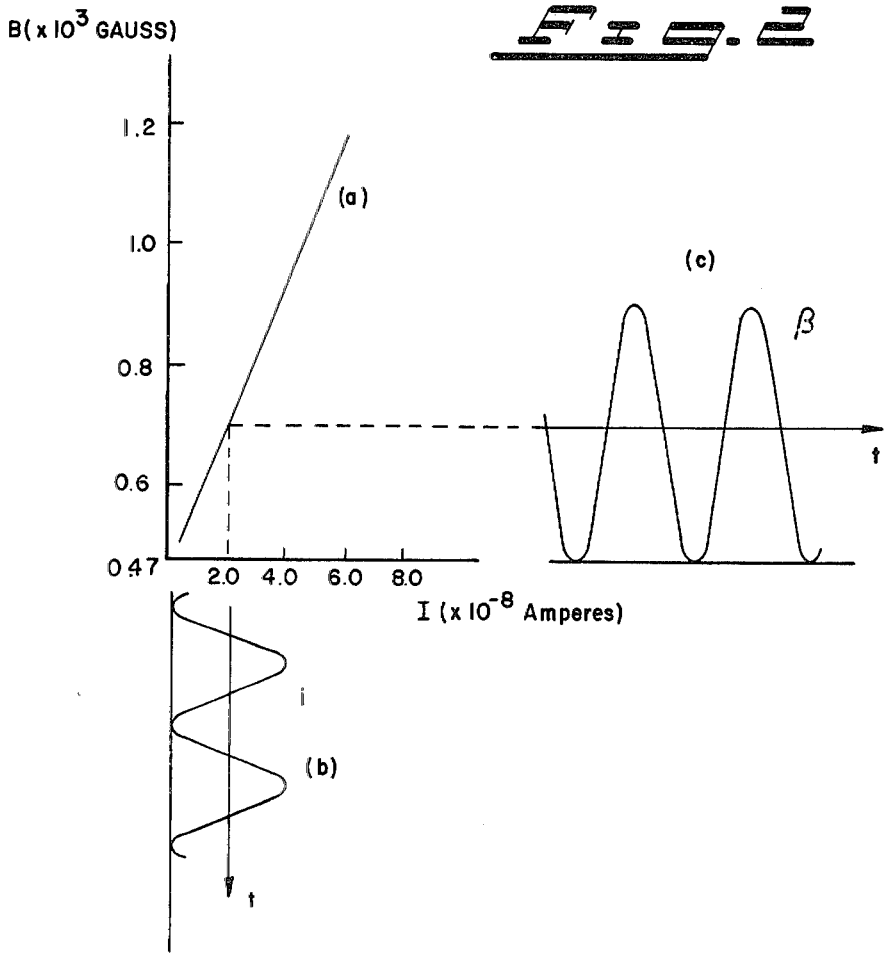
FIG. 2 illustrates the characteristics of the magnetic amplifying element of FIG. 1.

Furthermore, the characteristics shown in FIG. 2 are those for the situation where the exciting coil consists of 10 turns and it is wound around a flat bar-shaped magnetic amplifying element 1 in which the magetic amplifying element 1 is a permanent magnet with a high manganese content and a flux density of 470 gauss and a single carbon diamagnetic part 12 is utilized.

Furthermore, as is shown in FIG. 3, the antenna element 10 used in the present invention is formed by winding a director coil 2 around the magnetic amplifying element 1. In FIG. 4 is illustrated an equivalent circuit. As shown therein an LC resonant circuit is formed by the magnetic amplifying element 1 and the director coil 2. Of course, the L and C values can be adjusted by adjusting the number of turns of the director coil 2 and the length of the diamagnetic part 12. Adjustment can also be effected by connecting an adjusting capacitor 4 to both ends of the direct coil 2 as indicated by the broken line in FIG. 4. As a result, it is possible to vary the transmitting and receiving frequency characteristics. An amplifying circuit 52 is formed by the magnetic amplifying element 1 and a feedback LC circuit 53 is formed by lines of magnetic force in the air.

The principle of operation of the above-described antenna element 10 is surmised to be as follows: The microcurrent is transmitted or received by the director coil 2 is amplified by the magnetic amplifying element 1 and the amplifying effect is heightened by the feedback effect of the feedback LC circuit 53.

Referring to FIG. 5, shown therein is an antenna according to the teachings of this invention. The antenna of the present invention is formed by arranging magnetic amplifying elements 1 into a rectangular frame or loop 30 as is described below. In particular, two of the above-described antenna elements 10 are provided so that the magnetic fields of the elements 10 are oriented in opposite direction and the longitudinal axes of the elements 10 are parallel to each other. Two magnetized coupling members 20 are laterally installed at both ends of the two antenna elements 10 so that the magnetic lines of force 14 of the coupling magnetic members 20 connect perpendicularly with the magnetic lines of force 13 of the magnetic amplifying elements 1.

If the antenna is constructed as described above, the magnetic lines of force of the two magnetic amplifying elements 1 circle the rectangular frame 30. As a result, the two magnetic amplifying elements 1 are connected in series. Furthermore, a feedback function is performed by the magnetic lines of force 14' which are among the magnetic lines of force 14 of the coupling magnetic members 20 and which do not connect with the magnetic lines of force 13 in the magnetic amplifying elements 1.

It has been determined that it is possible to obtain an antenna whose degree of amplification is much higher than that of one utilizing a single antenna element 10. In FIG. 6 is illustrated this principle. When the magnetic amplifying elements 1 are excited by the director coils 2, magnetic lines of force 13 of the magnetic amplifying elements 1 increase or decrease in accordance with the microcurrent flowing through the director coils 2. Accordingly, the magnetic lines of force 14 of the coupling magnetic members 20, which connect with the magnetic lines of force 13, also increase or decrease. As a result, the magnetic lines of force 14' which extend into the air from the magnetic feedback member 20 increase or decrease and produce a feedback effect.

Referring to FIG. 7, shown therein is an equivalent circuit of the antenna of FIG. 5. In FIG. 7, LC resonant circuits 51 and 51' are formed by the director coils 2 and the magnetic amplifying elements 1. Amplifiers 52 and 52' are formed by the magnetic amplifying elements 11 and the LC feedback circuits 53 and 53'. With regard to input terminals for transmission or output terminals for reception, it is possible to use both terminals T and T' of the two director coils 2 connected in parallel or to use just one of the two coils or sets of terminals T and T'.

However, to increase the effectiveness of the abovedescribed antenna, the following condition should be satisfied:

(1) In order to eliminate distortion, the two antenna elements 10 and the two coupling magnetic members 20 should be made of the same material (i.e. should have identical characteristics).

(2) The effect of the invention can be increased by constructing a flat rectangular frame 30 using magnetic amplifying elements 1 and coupling magnetic members 20 which are flat in cross section (i.e. flat in a section perpendicular to the magnetic field of the part in question). As a result of such a construction, the transmitting and receiving sensitivities are stronger since the antenna elements 10 are flat; furthermore, the feedback effect is increased with the increase in the density of the magnetic flux oriented in the same direction.

(3) The coupling magnetic member 20 should be installed on the outside of both ends of the magnetic amplifying elements 11 (see FIG. 5). Specifically, this is done in order to ensure sufficient connection of the magnetic lines of force 13 and 14 (as shown in FIG. 6(*a*)) so that a sufficient series connection of the two antenna elements 10 is obtained. If, for example, the coupling magnetic members 20 are installed inside the antenna elements 10 (as shown in FIG. 6(*b*)), only a portion of the magnetic lines of force 13 of the two antenna elements 10 connect with the magnetic lines of force 14. As a result, the series connection effect is reduced and the effect of the invention is insufficient.

(4) Furthermore, various experiments have indicated that maximum effectiveness can be obtained by using permanent magnets with a high manganese content and a magnetic flux density of approximately 500 gauss for the magnetic members 11 used in the magnetic amplifying elements 1 and the coupling magnetic members 20 and by using carbon for the diamagnetic members 12.

Described below are measurements for an antenna in accordance with the teachings of the present invention which describes the conditions listed below.

| Conditions | |
|---|---|
| Magnetic parts 11 and 20: | Permanent magnets with a magnetic flux density of approximately 470 gauss |

-continued

| Conditions | |
|---|---|
| Diamagnetic parts 12: | Carbon (thickness (X): approximately 3 mm) |
| Director coils: | 12 turns |
| Size: | Length 7.3 cm; width 4 cm |
| Width (Y) of magnetic amplifying elements 1 and magnetic members 20: | 1.2 cm |

MEASUREMENT RESULTS

A receiving sensitivity of 180 decibels and an extremely low ghost range were obtained in a weak electric field region in which the receiving sensitivity of a Yagi antenna was only 30 decibels. The fact that the antenna provided in accordance with the teachings of the present invention thus exhibits phenomenal transmitting and receiving sensitivities results from the fact that two magnetic amplifying elements which have an amplifying function are used. Other factors which presumably affect the transmitting and receiving levels are the size of the antenna frame 30, the width Y of the magnetic amplifying elements 1 and the feedback magnetic members 20, the number of turns of the director coil 2, etc. The transmitting receiving levels rise with an increase in the size of the antenna frame 30, with an increase in the width Y of the magnetic amplifying elements 1 and the coupling magnetic members 20 and with an increase in the number of turns of the director coils 2.

Furthermore, factors which presumably affect the transmitting and receiving frequency characteristics are the thickness of the diamagnetic members 12 the number of turns of the director coils 2, the length of the coupling magnetic members 20, etc. The high frequency characteristics improve with an increase in the thickness of the diamagnetic members 12 and a decrease in a number of turns of the director coils 2. In particular, the frequency characteristics of the antenna of the present invention are set by the resonance frequencies of the LC resonant circuits 53 and 53' of the equivalent circuit of FIG. 7.

In addition, the antenna of the present invention is very directional. Generally, the directivity angle of a Yagi antenna is 60° or more. With the present invention, however, experimental results indicate a directivity angle of less than 40°. It should be apparent to one skilled in the art that the above described embodiment is merely illustrative of but one of the many possible specific embodiments which represent the application of the principles of the present invention. Numerous and varied other arrangements can be readily devised by those skilled in the art without departing from the spirit and scope of the invention.

Furthermore, since the magnetic members of this invention are all the simple stick type, the frame can be simply built and the coil can be wound easily. This results in a less costly structure.

We claim:

1. An antenna comprising:

a first elongated magnetic antenna member having a first magnetic pole orientation, said first elongated magnetic member comprising an elongated member made from magnetic material and at least one diamagnetic portion provided in the magnetic material and separating the magnetic material into at least two portions;

a second elongated antenna member having a second magnetic pole orientation opposite to the first magnetic pole orientation and provided adjacent and parallel to the first elongated magnetic member, said second elongated magnetic member comprising an elongated member made from magnetic material and at least one diamagnetic portion provided in the magnetic material and separating the magnetic material into at least two portions; p1 a pair of third elongated magnetic members connecting the ends of said first and second elongated members to form a magnetic loop, said first, second and third elongated members being arranged and configured such that the lines of magnetic force in the third members connect with the lines of the magnetic force in the first and second members; and a coil wound on each of said first and second elongated magnetic members.

2. An antenna according to claim 1 wherein the magnetic loop is in the shape of a rectangle.

3. An antenna according to claim 2 wherein the first, second and third members are flat in cross section.

4. An antenna according to claim 2 wherein the rectangular shape is formed by providing third elongated magnetic members on the outside of both ends of the first and second elongated magnetic members.

* * * * *